United States Patent [19]

Montagni

[11] Patent Number: 4,834,038

[45] Date of Patent: May 30, 1989

[54] TIMING DEVICE FOR RECIPROCATING POSITIVE-DISPLACEMENT ENGINES, SUCH AS ENDOTHERMIC RECIPROCATING ENGINES, WITH A ROTARY VALVE IN THE SHAPE OF A SOLID OF REVOLUTION PARTICULARLY A SPHERE

[76] Inventor: Alviero Montagni, Via Lungo l'Africo No. 2 174, 50137 Firenze, Italy

[21] Appl. No.: 186,588

[22] Filed: Apr. 27, 1988

[30] Foreign Application Priority Data

Apr. 30, 1987 [IT] Italy ..... 9384 A/87

[51] Int. Cl.[4] ..... F01L 7/00

[52] U.S. Cl. ..... 123/190 BD; 123/41.40; 123/190 D; 123/190 DL; 123/190 E

[58] Field of Search .... 123/190 BD, 190 D, 190 DL, 123/190 E, 41.40

[56] References Cited

U.S. PATENT DOCUMENTS

| | | | |
|---|---|---|---|
| 1,649,235 | 11/1927 | Jones | 123/19 BD |
| 1,860,725 | 5/1932 | Stoner | 123/41.4 |
| 2,216,836 | 10/1940 | Gross | 123/190 BD |
| 2,369,566 | 2/1945 | Hall | 123/190 D |
| 2,725,043 | 11/1955 | Bacot | 123/190 B |
| 2,730,089 | 1/1956 | French | 123/80 D |
| 2,895,459 | 7/1959 | Sbaiz | 123/190 BD |

FOREIGN PATENT DOCUMENTS

| | | | |
|---|---|---|---|
| 36758 | 8/1930 | France | 123/190 BD |

*Primary Examiner*—E. Rollins Cross
*Attorney, Agent, or Firm*—McGlew & Tuttle

[57] ABSTRACT

For each cylinder a timing device comprises at least one valve (12) in the shape of a solid of revolution which rotates inside a corresponding recess (15) in a seat formed in the cylinder head (1), the surface of the recess mating with that of the valve; at least one intake and/or exhaust pipe (7, 9) which communicates with the recess; at least one pipe (10) which connects the recess with the space inside the cylinder (3) of the reciprocating engine. The valve has at least one facet (13) or a recess or an eccentric hole which allows communication between the intake and/or exhaust pipe (7,9) and the pipe (10) which connects with the space inside the cylinder while the valve itself is rotating. Actuating devices are provided which cause the valve to rotate in synchronization with the phases of the reciprocating engine. The actuating devices of the valve comprise a camshaft (17) to which the valve is connected so that it can rotate and also slide, the axis of the shaft coinciding with the axis of revolution of the solid of revolution which forms the valve itself.

16 Claims, 2 Drawing Sheets

TIMING DEVICE FOR RECIPROCATING POSITIVE-DISPLACEMENT ENGINES, SUCH AS ENDOTHERMIC RECIPROCATING ENGINES, WITH A ROTARY VALVE IN THE SHAPE OF A SOLID OF REVOLUTION PARTICULARLY A SPHERE

FIELD AND BACKGROUND OF THE INVENTION

The invention concerns a timing device for reciprocating positive-displacement engines, such as endothermic reciprocating engines, reciprocating compressors and the like in which at least one rotary valve in the shape of a solid of revolution and particularly a sphere is provided for each cylinder instead of the usual poppet valves which are controlled by rocker arms and kept closed by springs.

SUMMARY OF THE INVENTION

According to the invention, for each cylinder a timing device comprises at least one valve in the shape of a solid of revolution which rotates inside a corresponding recess in a seat formed in the cylinder head. The surface of the said recess mates with that of the valve. At least one intake and/or exhaust pipe communicates with the recess; at least one pipe connects the recess with the space inside the cylinder of the reciprocating engine. The valve has at least one facet or a recess or an eccentric hole which allows communication between the intake and/or exhaust pipe and the pipe which connects with the space inside the cylinder when the valve itself is rotating. Actuating devices are provided to cause the valve to rotate in synchronization with the phases of the reciprocating engine; the actuating devices of the valve comprise a camshaft to which the valve is connected so that it can rotate and also slide, the axis of the shaft coinciding with the axis of revolution of the solid of revolution which forms the valve.

Advantageously the facet is approximately flat and the plane of it is parallel to the axis of rotation of the said valve.

BRIEF DESCRIPTION OF THE DRAWINGS

The drawing shows a non-limiting, practical embodiment. In the drawings.

DESCRIPTION OF THE PREFERRED EMBODIMENT

Figure 1:
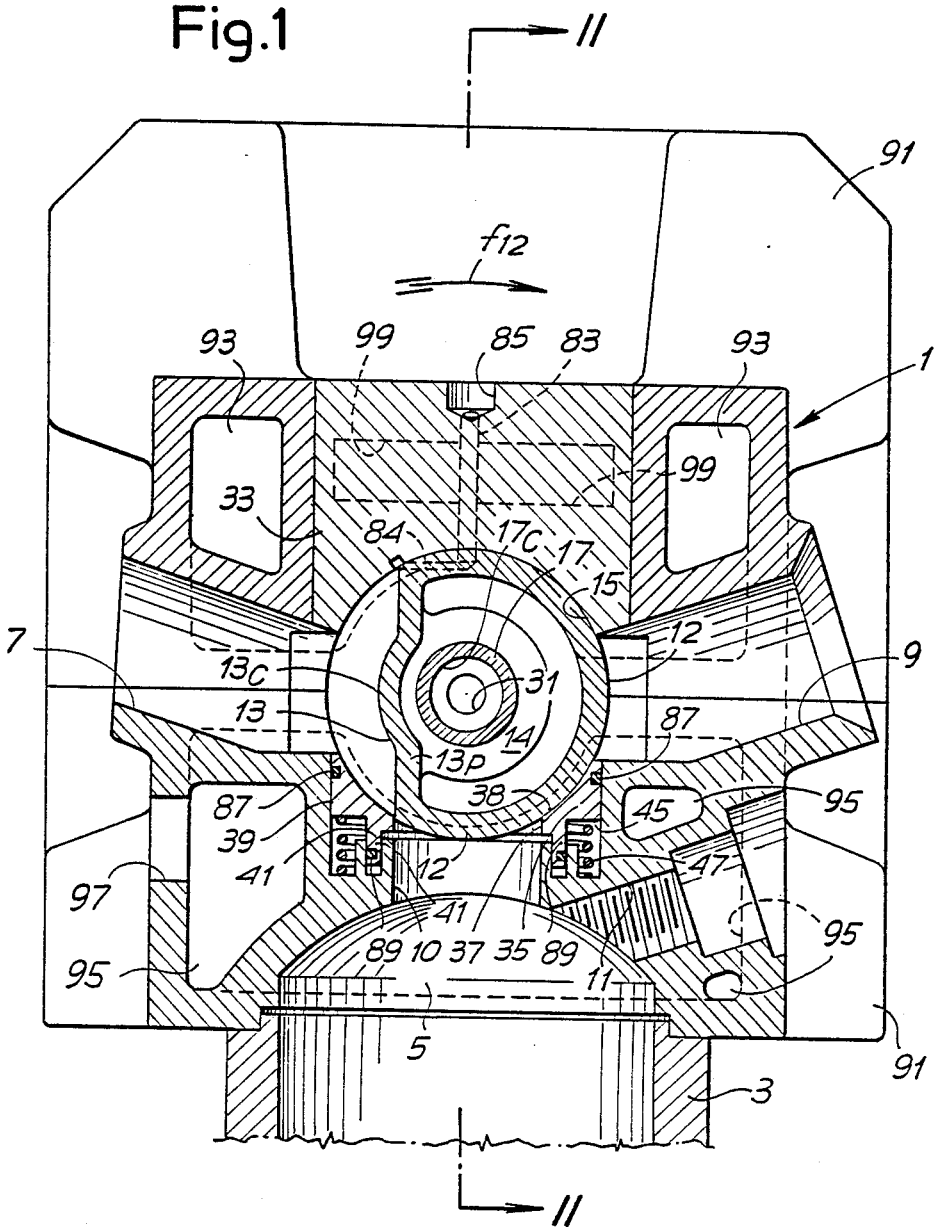
FIG. 1 is a schematic diagram of a sectional view of the head (or cylinder head) of a reciprocating internal combustion engine.

In FIG. 1, a part generally designated 1 of the head (or cylinder head) covers the top of cylinder 3 of a reciprocating internal combustion engine. Numeral 5 represents the combustion chamber of the cylinder, 7 designates the intake pipe and 9 designates the exhaust pipe. 11 represents a slanted, threaded hole for fitting a spark plug or injector to head 1. A pipe or channel 10, which is coaxial with cylinder 3 in the example in the drawing, opens into the center of combustion chamber 5; typically it is made to communicate alternately with intake pipe 7 and exhaust pipe 9 via rotary valve 12. Rotary valve 12 (in the example in the drawing) is in the shape of a sphere but may alternatively be any other solid of revolution with a convex surface (such as an ellipsoid), rotating round its own axis of revolution.

Valve 12 is incomplete at 13 and does not therefore have a cap corresponding to an angle at the center of approx. 120 degrees; in place of the missing cap, valve 12 has a surface 13 or facet which is basically flat except for a convex section 13C, the purpose of which will be described below.

Figure 2:
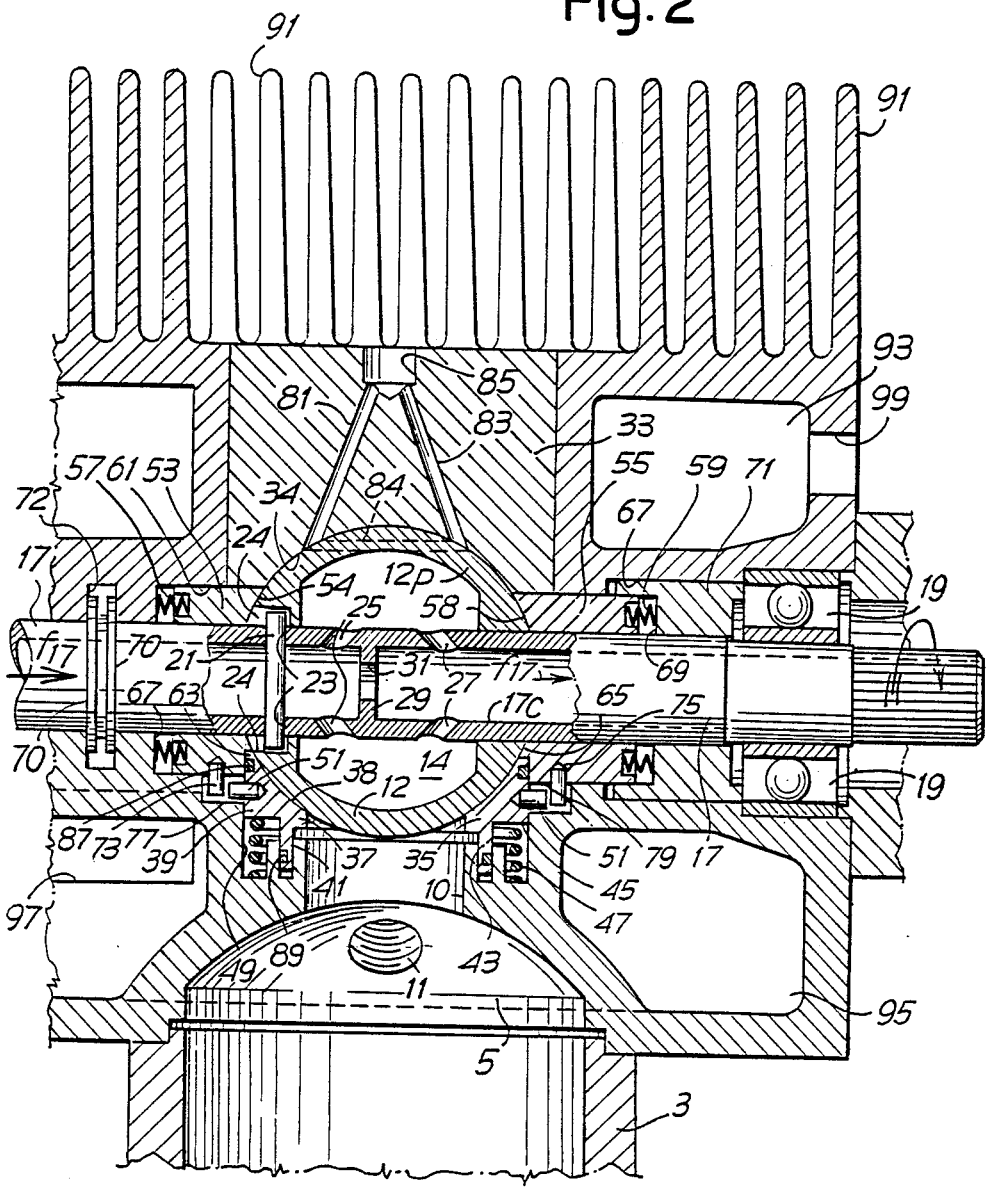
FIG. 2 is a sectional view through II—II in FIG 1.

In place of the facet, at 13 valve 12 may have a groove-type recess or even a hole, the axis of which corresponds to the chord of the great circle of the sphere as shown in FIG. 2, the said chord being a certain distance from the external surface of shaft 17 which, as will become apparent below, controls the rotation of valve 12. As will be explained in detail below, the facet, the recess and the hole located at 13 all perform the function of conveying towards or away from the inside of cylinder 3 fluid aspirated or discharged by the cylinder via pipe 10.

Valve 12 is made to rotate in the direction of arrow f12 inside recess 15 which is also spherical or of the same shape as said valve 12 itself, the surfaces of recess 15 forming a seal with the surface of valve 12 which slides inside it. Valve 12 is made to rotate by means of a camshaft 17 (FIG. 2) mounted on bearings like that illustrated by 19 and housed inside the head of which section of head 1 forms part. The convex, curved part of surface 13 is such that surface section 13P may match the curved course of shaft 17 a certain distance away. A transverse pin 21 placed inside holes 23 on shaft 17 is used to make valve 12 rotate. The ends of pin 21 engage in seats 24 on the valve which are suitably extended on both sides to allow for the fact that the thermal expansion of the shaft and of the valve may differ during operation; the valve may therefore slide and settle into its correct operating position inside recess 15 irrespective of any changes in temperature. As may be seen from FIG. 1, in the various positions occupied by valve 12 when it rotates according to arrow f12, surface 13, or a recess or a through hole in its place, as has just been mentioned, first forms a passage with the surface of seat 15 (in the sequence of the phases of a standard four-stroke engine) which connects intake pipe 7 with pipe 10, causing the induction phase to take place. The cross-section of this passage changes from a minimum to a maximum value and then returns to zero again when the spherical surface of valve 12 closes pipe 10 for a certain period of time during which the compression, combustion and expansion phases take place. When this closure period has finished, approximately at the end of or just before the end of the expansion phase, surface 13 forms a passage with seat 15 for a second time, connecting exhaust pipe 9 with pipe 10 and with the inside of cylinder 3 and causing the exhaust phase to take place. In the example shown in the drawing the induction phase takes up approx. 90 degrees of the rotation of valve 12, 180 degrees are taken up by the compression, combustion and expansion phase and the remaining 90 degrees by the exhaust phase. This is the standard timing of the phases of a four-stroke, low-revolution engine. By varying the angle at the center by which the chord of facet 13 is subtended and/or the position of pipes 7 and 9 it is possible to advance and/or retard both the induction and the exhaust phases, thereby also allowing so-called crossing or scavenging to take place.

For cooling purposes valve 12 consists of a hollow shell defined by a genuinely spherical wall 12P and wall 13P which matches surface 13. Internal space 14 of valve 12 is cooled with cooling air (or a liquid coolant)

which reaches it via inlet holes 25 and outlet holes 27 which connect internal space 14 with the internal pipe 17C of shaft 17 which is tubular in shape. In the example shown in the drawing the cooling air—which may be part of the cooling air for the engine provided by a fan or which may also come from a suitable blower or other means—enters shaft 17 in the direction of arrow f17, enters recess 14 via holes 25 and leaves via holes 27, holes 25 being inclined and divergent to promote the ingress of the air into valve 12 and holes 27 being inclined and convergent in order to promote its departure. Immediately downstream of holes 25 inside shaft 17 is a diaphragm 29 with a central hole 31 forming a restricted opening which limits the passage of the air entering, thus causing the pressure of the air at the mouth of holes 25 to increase; this increase helps the greatest possible volume of air to pass through them. Because of a "Venturi" effect due to hole 31, however, there is a pressure drop downstream of diaphragm 29 which increases the speed with which the air leaves space 14 via holes 27.

Valve 12 is made of steel or another metallic material that is suitable, particularly as regards the achievement of a perfectly smooth external surface (by lapping or some other method). Seat 15 inside which valve 12 rotates has a configuration like that of valve 12 apart from the gaps due to pipes 7, 9, 10 and the holes through which the shaft passes, but is in several parts which may be made of steel or another suitable metal, but preferably another material such as graphite for example. Inside a suitable seat machined in the metal head block and above valve 12 is a bush or cap 33, usually of graphite, which constitutes a solid of revolution, the bottom of which is defined by a recess 34 in the shape of a spherical cap, the concave surface of which is able to mate perfectly with the convex surface of valve 12. The position of bush 33 with respect to valve 12 may be defined in such a way as to obtain optimum contact for the purposes of leak-tightness, the bush being made to slide inside the seat and be locked with adjusting screws (not shown).

At the bottom (on the drawing) and opposite to bush 33 is a bush 35, usually made of cast iron, which is also a solid of revolution with a hole 37 in the center which is the same diameter as pipe 10 of which it is an extension. The surfaces of bush 35 are shaped in different ways so that there is a concave area 38 which is in contact with the surface of valve 12, an external cylindrical surface 39, the internal cylindrical surface 37 which extends hole 10 and in such a way that there is a short tubular guide sleeve 41 which can slide inside a corresponding annular seat 43 with cylindrical surfaces surrounding hole 10 machined in the section of the head. Between external surface 39 and the external surface of sleeve 41 is a step 45 which receives the thrust of a compression spring 47 to keep the surface of area 38 in close contact with the surface of valve 12 at all times. Spring 47 acts on the bottom of an annular guide slot 49 outside the annular sliding seat 43 of sleeve 41. Radial pegs 51 prevent bush 35 from decending too far if spring 47 breaks.

Bushes 53 and 55, which slide inside cylindrical seats 61 and 67, are in the shape of solids of revolution and are usually made of graphite, surround both sides of valve 12 and each has its own concavity 54 and 58 with concave surfaces which mate with the surface of valve 12. Their springs 57 and 59 push bushes 53 and 55 centripetally, i.e. in the axis of rotation of shaft 17, so as to ensure contact between concavities 54 and 58 and the surface of valve 12. Concavities 54 and 58 have a portion missing at the bottom as each has a notch 63 and 65 which can prevent bushes 53 and 55 from touching the cylindrical contour 49 of bush 35. Concavities 54 and 58 are interrupted also at the sides—i.e. they do not surround the surface of valve 12 up to the meridian which lies in a plane which is orthogonal to the axis of shaft 17—so as not to touch the ends of pipes 7 and 9. Spring 57 acts against an annular shoulder 67 which (on the left of FIG. 1) bounds hollow seat 61 inside which bush 53 slides; similarly spring 59 acts against an annular shoulder 69 which (on the right of FIG. 2) bounds hollow seat 67 inside which bush 55 slides. The shoulder 69 is machined onto the front (opposite bearing 19) of a sleeve 71 which serves as a spacer, to complete and close recess 67 and which may also act as a bush. 70 represents a double shoulder which may absorb the axial thrusts from shaft 17; this shoulder rotates inside an annular slot 72 machined from the material of which the head is made. The potential centrifugal travel of bushes 53 and 55 is also delimited by their radial pegs 73 and 75 which face downward and slide inside seats 77 and 79 within certain limits. A pair of thin pipes 81 and 83 which are inclined, lead into a top recess 85 on the head and are for cooling purposes cross top bush 33; in some cases they may also be used to lubricate valve 12 from the top. At the point at which they emerge into recess 34, pipes 81 and 83 are connected by a groove 84 which is in the shape of a bow with the circumference on the surface of the recess.

As bush 35 is subject to the pressure of the gases during the compression, combustion and expansion phases—as is valve 12—it has a flexible sealing ring 87 (or similar) fitted to cylindrical surface 39 and another ring 89 fitted to the external surface of sleeve 41. This ensures that gas cannot pass along these surfaces.

In the example in the drawing, the head (or cylinder head) of which section 1 is part is air cooled and yet has cooling fins 91 in a configuration which is already known, some of the fins having gaps for access to pipes 7 and 9, recess 85 and hole 11 and for the space occupied by the plug or the injector.

In the version described of the invention the cooling system also enable cooling air to circulate inside pipes (machined in the cylinder head block) in positions such that the surfaces of seat 15 are cooled either directly or indirectly. The said pipes shown as 93 and 95 are approximately circular, with a rectangular section or similar, and have an inlet hole 97 at the point where the cylinder head section 1 joins the corresponding section of a cylinder which is contiguous with cylinder 3 and an outlet hole 99, the said pipes being able to communicate with each other. It is clear that where water cooling is employed, pipes 93 and 95 can be used to circulate the water and can be supplied with the cooling water that circulates in the engine block in the usual way.

In the example in the drawing, valve 12 has a single "facet" consisting of surface 13 but it is clear that it may also have two and possibly more than two facets (or recesses or through holes positioned in similar fashion on surface 13) located at equal angular distances and suitably spaced. When there is only one facet the number of revolutions of valve 12 is half the number of engine revolutions (as for the timing shaft of a standard four-stroke engine); with two facets the number of revolutions of the valve is one quarter of that of the engine whilst with three facets the number of revolutions is one sixth of that of the engine.

The timing device offers considerable advantages compared with conventional ones, such as the omission of valve springs and the disadvantages associated with them, wider passages for the fluids that are aspirated or discharged, the reduced mechanical power level absorbed by the camshaft, the possibility of obtaining high compression ratios etc. In addition the entire system is very simple in construction and certainly very modest in terms of cost if mass-produced. Valve 12 does not require lubricating for the standard speeds of rotation of a motor-transport engine. Limited lubrication is however, possible via pipes 81, 83 with a drip-feed type of system, for example. The device according to the invention has the further advantage of enabling solid ribbon-like fuel to be used in an endothermic engine to which it is fitted, as valve 12 ensures that suitable segments will be cut from the ribbon which feeds through, for example, at the end of the induction phase.

For high-powered engines the invention also offers the possibility of using two rotary valves (rather than only one) in the shape of a solid of revolution with a convex surface, with at least one facet (or recess or hole), with the first valve connecting the intake pipe with an inlet pipe in the combustion chamber of a cylinder in synchronization with the phases of the engine's cycle and the second valve connecting the exhaust pipe with an outlet pipe from the combustion chamber of the said cylinder in synchronization with the said phases. The said two rotary valves may be spherical in shape with a facet similar to valve 12; the two valves may also differ from one another in that by varying the angle at the center of the chord of the great circle to which the facet corresponds it is possible to control the duration of the corresponding induction or exhaust phase. In this case each rotary valve will have a single function, but the design will be the same as the preceding one.

The drawing only shows an example, the shapes and configurations of which may vary.

I claim:

1. A timing device for reciprocating positive-displacement engines comprising: a cylinder; a cylinder head associated with said cylinder, said cylinder head defining a recess and defining an intake which communicates with said recess and also defining an exhaust which communicates with said recess; a valve in the shape of a solid of revolution disposed for rotation within said recess, said cylinder head forming a valve seat corresponding to said valve; a channel formed in said cylinder head providing communication between said cylinder and said recess; communication means associated with said valve for providing communication between said intake and/or exhaust pipe and said channel upon rotation of said valve; and, actuating means for causing said valve to rotate in synchronization with the phases of the reciprocating positive-displacement device, said actuating means including a cam shaft extending through said cylinder head, said cam shaft being connected to said valve to allow said valve to rotate and slide with said cam shaft, the axis of said cam shaft coinciding with the axis of the solid of revolution forming the shape of said valve.

2. The device as claimed in claim 1, wherein the said communication means includes a facet formed in said valve, said facet being approximately flat and the plane of said facet being parallel to the axis of rotation of the said valve.

3. The device as claimed in claim 1, wherein said valve is hollow and cooled by a liquid coolant circulating inside said camshaft, and inside the hollow space of said valve by means of holes formed on said camshaft located so as to match the valve.

4. The device as claimed in claim 3, wherein a first set of the said holes in inclined so as to promote the passage of the said liquid coolant from the camshaft to the valve and a second set of the said holes is inclined so as to promote passage in the opposite direction.

5. The device as claimed in claim 4, wherein, said shaft is fitted with a restricted portion corresponding to said valve positioned between said first and second set of said holes so as to create a pressure gradient between the two sets of holes with the purpose of facilitating the partial circulation of the coolant inside the valve.

6. The device as claimed in claim 1, wherein said seat comprises a bush type element adjustably positioned coaxial to and opposite to the cylinder, and at least two opposing annular elements positioned on the camshaft, each of said opposing annular elements having concave sections which in part define the internal surface of the said recess for the said valve, said opposing annual elements being housed in the cylinder head.

7. The device as claimed in claim 6, wherein a further annular element is provided to make up the said seat, round the passage between the seat and the cylinder.

8. The device as claimed in claim 6, wherein the said annular elements are stressed with respect to each other and with respect to the valve by means of flexible elements.

9. The device as claimed in claim 7, wherein at least one of the said elements is made of a self-lubricating material such as graphite.

10. The device as claimed in claim 1, wherein pipes to cool the seat of the said valve are machined inside the cylinder head.

11. The device as claimed in claim 7, wherein at least one of the said annular elements making up the said seat has sealing rings to counteract the passage of gases from the cylinder.

12. The device as claimed in claim 1, wherein the valve is spherical in shape with said communication means including a facet, the recess having an internal surface that is basically spherical and coincides with the surface of the said valve.

13. The device as claimed in claim 1, wherein the said seat of the said valve has cooling and/or lubrication pipes for the said valve.

14. The device as claimed in claim 1, wherein said communication means, said intake and exhaust pipes are located in such a way that the induction phase may be advanced and/or the exhaust phase retarded.

15. The device as claimed in claim 1, wherein a first rotary valve is connected to the intake pipe and to a first pipe which connects with the space inside the corresponding cylinder, and a second rotary valve is connected to the delivery or exhaust pipe and to a second pipe which connects with the space inside the said cylinder.

16. A timing device for reciprocating positive-displacement devises, comprising: a cylinder defining a cylinder space; a valve head positioned adjacent said cylinder, said valve head defining a recess; an intake conduit; a discharge conduit; a communication channel connecting said recess and said cylnder space; a valve seat positioned within said recess; a substantially spherical valve body including one of a facet, a communication recess and an eccentric hole allowing communication between one of the intake and exhaust with the communication channel; and a camshaft connected with said substantially spherical valve for rotating said valve, the axis of rotation of said camshaft coinciding with a an axis of rotation of said substantially spherical valve, said substantially spherical valve being hollow defining a cooling space, said camshaft being substantially hollow defining a cooling channel, holes formed in said camshaft providing communication between said cooling channel and said cooling space of said substantially spherical valve.

* * * * *